US011344901B2

(12) United States Patent
Shih

(10) Patent No.: US 11,344,901 B2
(45) Date of Patent: May 31, 2022

(54) SPRAY GUN NOZZLE

(71) Applicant: Nien-Tsu Shih, Changhua (TW)

(72) Inventor: Nien-Tsu Shih, Changhua (TW)

( * ) Notice: Subject to any disclaimer, the term of this patent is extended or adjusted under 35 U.S.C. 154(b) by 0 days.

(21) Appl. No.: 17/039,813

(22) Filed: Sep. 30, 2020

(65) Prior Publication Data

US 2021/0094052 A1 Apr. 1, 2021

(30) Foreign Application Priority Data

Sep. 30, 2019 (TW) ..... 108212931

(51) Int. Cl.
*B05B 7/06* (2006.01)
*B05B 7/08* (2006.01)

(52) U.S. Cl.
CPC ..... *B05B 7/066* (2013.01); *B05B 7/0815* (2013.01)

(58) Field of Classification Search
CPC ..... B05B 7/066; B05B 7/0815
USPC ..... 239/296, 299, 423–424.5, 601
See application file for complete search history.

(56) References Cited

U.S. PATENT DOCUMENTS

2006/0283985 A1* 12/2006 Ikeuchi ..... B05B 7/2435 239/543

* cited by examiner

*Primary Examiner* — Christopher S Kim
(74) *Attorney, Agent, or Firm* — Che-Yang Chen; Law Office of Michael Chen

(57) ABSTRACT

A spray gun nozzle may include a main body, and a spray hole is formed at a front end thereof. A tapered cylindrical guiding surface having gradually wider diameter from rear to front is extended forwardly from the spray hole, and the inclined angle of the guiding surface with respect to the spray hole is between 45 degrees and 75 degrees. A plurality of air grooves having U-shaped cross-section are formed on the outer periphery of the front end of the main body axially extending from a front end of the guiding surface, and the air grooves are spaced apart with the same interval. With the air grooves on the front end of the main body having the fixed groove diameter, the flow rate of the high-pressure airflow passing through the air groove is consistent.

7 Claims, 16 Drawing Sheets

SPRAY GUN NOZZLE

FIELD OF THE INVENTION

The present invention relates to a nozzle and more particularly to a spray gun nozzle.

BACKGROUND OF THE INVENTION

Referring to FIGS. 12-16, a conventional spray gun nozzle comprises a main body (30), and an opening (31) is formed at a front end thereof. An annular wall (32) is expanded forwardly from the opening (31), and a plurality of V-shaped air recesses (33) are formed on the annular wall (32) at positions corresponding to the long sides of the outer periphery of the main body (30). When the main body (30) is connected to a spray gun (40), a front portion of the main body (30) is covered and limited by an air cap (41), and a front end of the air cap (41) has a through hole (411) formed at an axial center thereof, and a front end of the main body (30) penetrates through the through hole (411), and an annular slit (412) is formed between the front end of the main body (3) and the through hole (411). High-pressure air flow (B) is adapted to pass out through the annular slit (412) and to mix and push the paint (A) out of the main body (30).

However, the conventional spray gun nozzle has following disadvantages: (i) the V-shaped air recess (33) is gradually wider from rear to front, so that the air flow (B) is configured to make contact with the narrow part of air recess (33) first when passing through the air recesses (33); as a result, the weak air flow (B) will cause insufficient power to spray the paint (A) out of the spray gun (40), uneven mixture of the paint (A), and the blocked annular slits (412) due to the paint (A) remaining on the air cap (41) and the through hole (411). Therefore, there remains a need for a new and improved design for a spray gun nozzle to overcome the problems presented above.

SUMMARY OF THE INVENTION

The present invention provides a spray gun nozzle comprising a main body, and a spray hole is formed at a front end thereof. A tapered cylindrical guiding surface having gradually wider diameter from rear to front is extended forwardly from the spray hole, and the inclined angle of the guiding surface with respect to the spray hole is between 45 degrees and 75 degrees. A plurality of air grooves having U-shaped cross-section are formed on the outer periphery of the front end of the main body axially extending from a front end of the guiding surface, and the air grooves are spaced apart with the same interval.

In one embodiment, the preferred inclined angle of the guiding surface with respect to the spray hole is 60 degrees.

In another embodiment, the main body is surrounded by an air cap of a spray gun when connected to the spray gun, and a through hole formed at a center of the air cap is adapted to be passed through by the front end of the main body, and the front end of the main body protrudes 0.7-1.2 mm out of the through hole.

In still another embodiment, a tapered cylindrical first surface having gradually wider diameter from rear to front is extended forwardly from the guiding surface of the main body, and the inclined angle of the first surface with respect to the spray hole is between 30 degrees and 45 degrees.

In a further embodiment, the preferred inclined angle of the first surface with respect to the spray hole is 38 degrees.

In still a further embodiment, two lateral sides of the air groove are formed in parallel.

In yet a further embodiment, two lateral sides of the air groove are non-parallel with an outward expanding angle between 1 degree and 9 degrees.

In a preferred embodiment, the width of the opening of the air groove is between 0.8 mm and 1.2 mm.

In an advantageous embodiment, the preferred width of the opening of the air groove is 1.0 mm.

In a particular embodiment, each of two corners of U-shaped bottom of the air groove is formed with radian between 0.2 mmR and 0.5 mmR.

In another particular embodiment, each of two corners of U-shaped bottom of the air groove is formed with the preferred radian 0.4 mmR.

In still another particular embodiment, the length of the air groove is between 2.5 mm and 3.5 mm.

Comparing with conventional spray gun nozzle, the present invention is advantageous because: With the air grooves on the front end of the main body having the fixed groove diameter, the flow rate of the high-pressure airflow passing through the air groove is consistent, such that the flux of the high-pressure airflow is increased, so as to well mix the paint and increase the flux of the paint out of the main body, thereby preventing the paint from remained on the air cap and improving the painting efficiency and result.

DETAILED DESCRIPTION OF THE INVENTION

Figure 1:
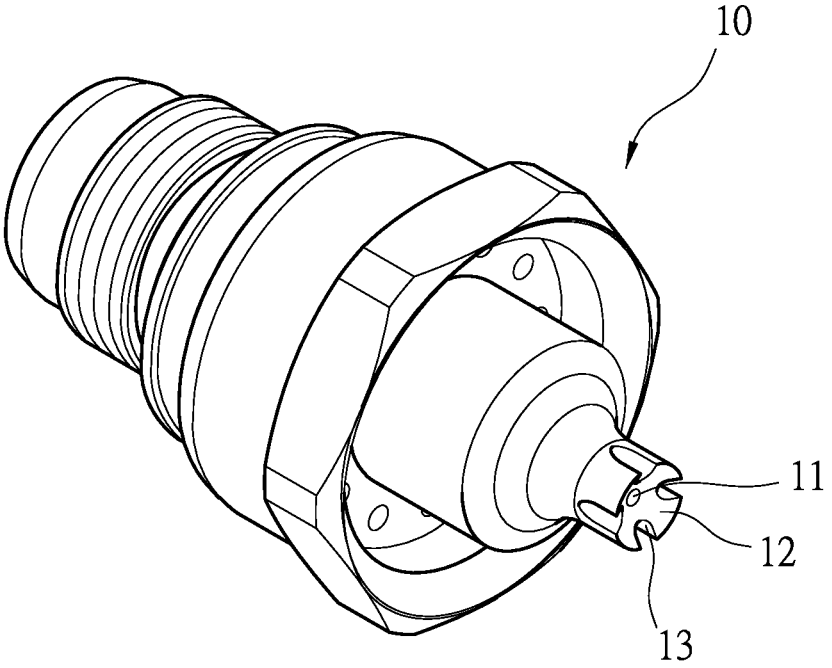
FIG. 1 is a three-dimensional assembly view of a spray gun nozzle of the present invention.
Figure 2:
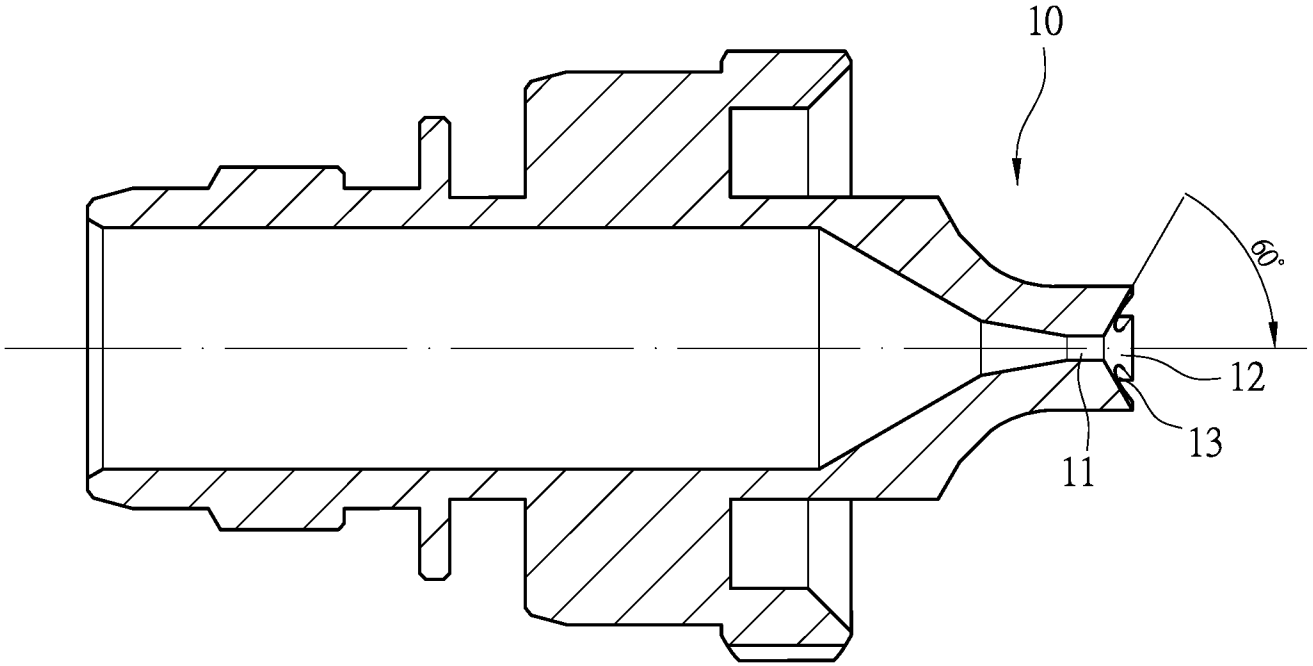
FIG. 2 is a sectional view of the spray gun nozzle of the present invention.
Figure 3:
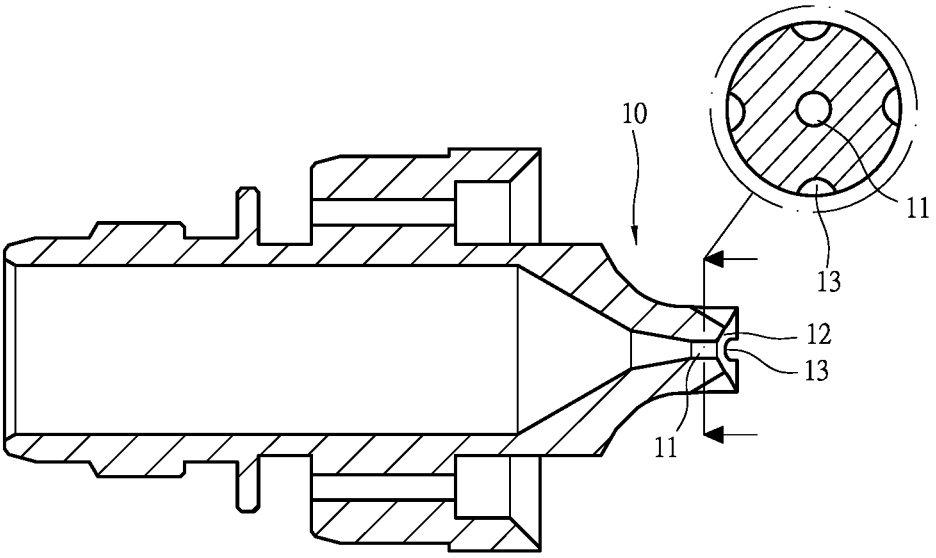
FIG. 3 is a partial enlarged sectional view of a front end of a main body of the spray gun nozzle in the present invention.
Figure 4:
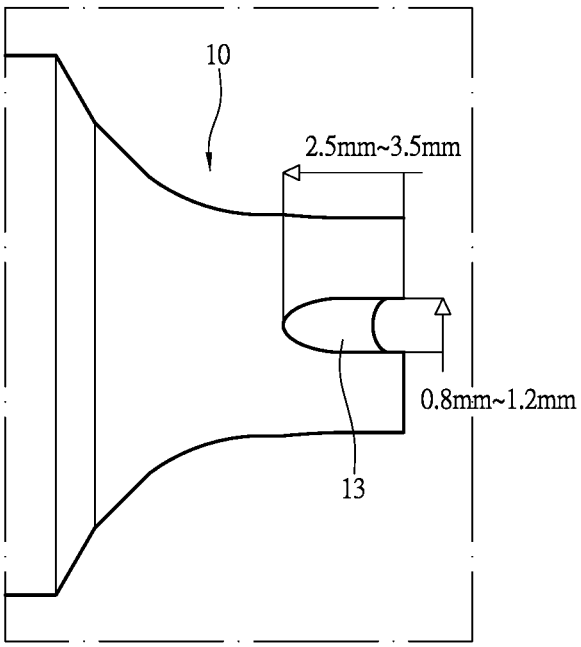
FIG. 4 is a partial enlarged lateral view of the front end of the main body of the spray gun nozzle in the present invention.
Figure 5:
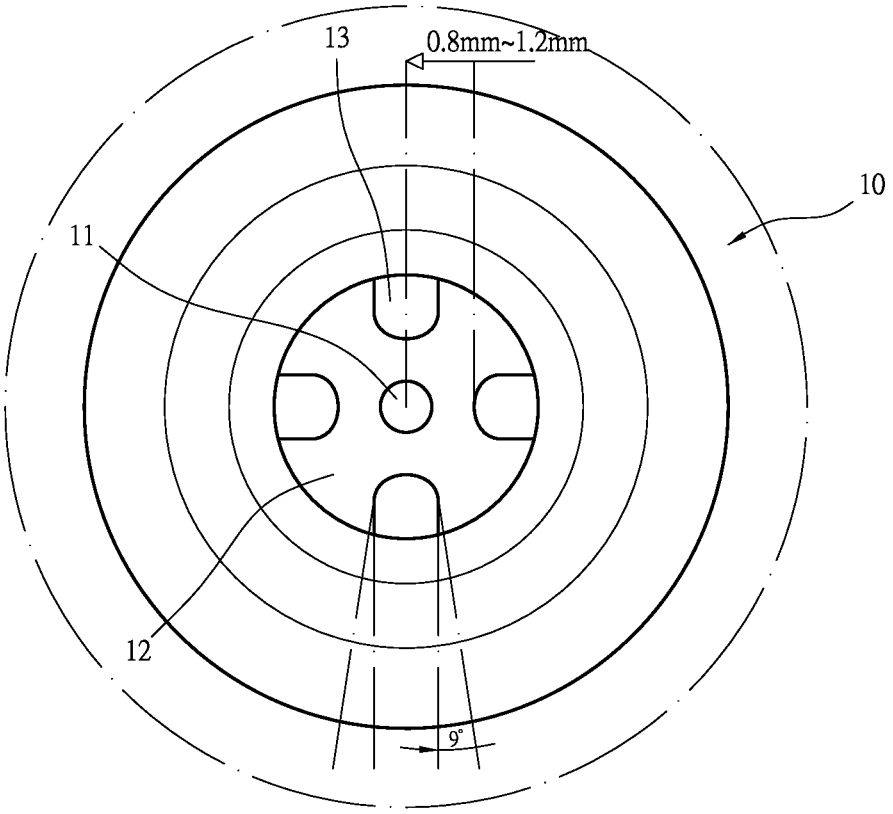
FIG. 5 is a partial enlarged front view of the front end of the main body of the spray gun nozzle in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 5, the present invention provides a spray gun nozzle comprising a main body (10), and a spray hole (11) is formed at a front end thereof. A tapered cylindrical guiding surface (12) having gradually wider diameter from rear to front is extended forwardly from the spray hole (11), and the inclined angle of the guiding surface (12) with respect to the spray hole (11) is between 45 degrees and 75 degrees, and the preferred inclined angle of the guiding surface (12) with respect to the spray hole (11) is 60 degrees. Moreover, a plurality of air grooves (13) having U-shaped cross-section are formed on the outer periphery of the front end of the main body (10) axially extending from a front end of the guiding surface (12), and the air grooves (13) are spaced apart with the same interval.

In one embodiment, the distance between the center of the spray hole (11) and the U-shaped bottom of the air groove (13) is between 0.8 mm and 1.2 mm, which achieves of better airflow guiding rate, spray performance, and easy cleaning.

In another embodiment, two lateral sides of the air groove (13) are formed in parallel.

In still another embodiment, two lateral sides of the air groove (13) are non-parallel with an outward expanding angle between 1 degree and 9 degrees.

In a further embodiment, the width of the opening of the air groove (13) is between 0.8 mm and 1.2 mm, and the preferred width of the opening of the air groove (13) is 1.0 mm.

In still a further embodiment, each of two corners of U-shaped bottom of the air groove (13) is formed with radian between 0.2 mmR and 0.5 mmR, and the preferred radian is 0.4 mmR.

In a particular embodiment, the length of the air groove (13) is between 2.5 mm and 3.5 mm to form the preferred air flow.

Figure 6:
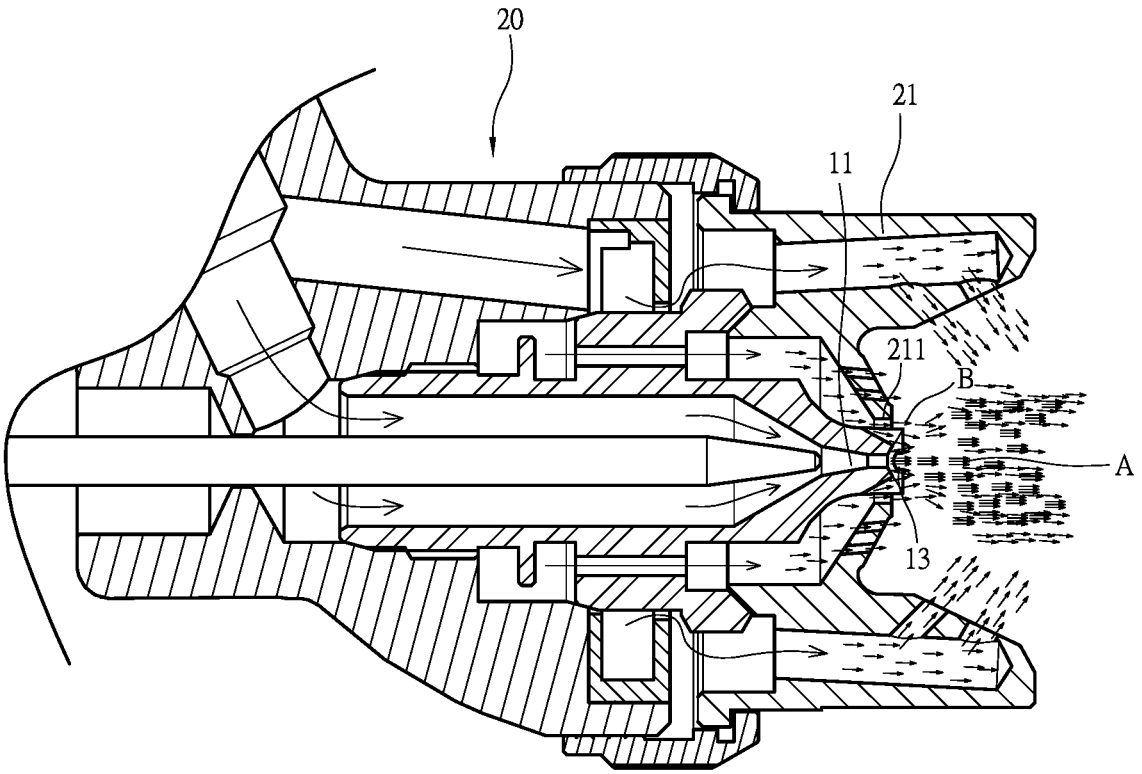
FIG. 6 is a schematic view illustrating the main body of the spray gun nozzle is connected to a spray gun for use in the present invention.
Figure 7:
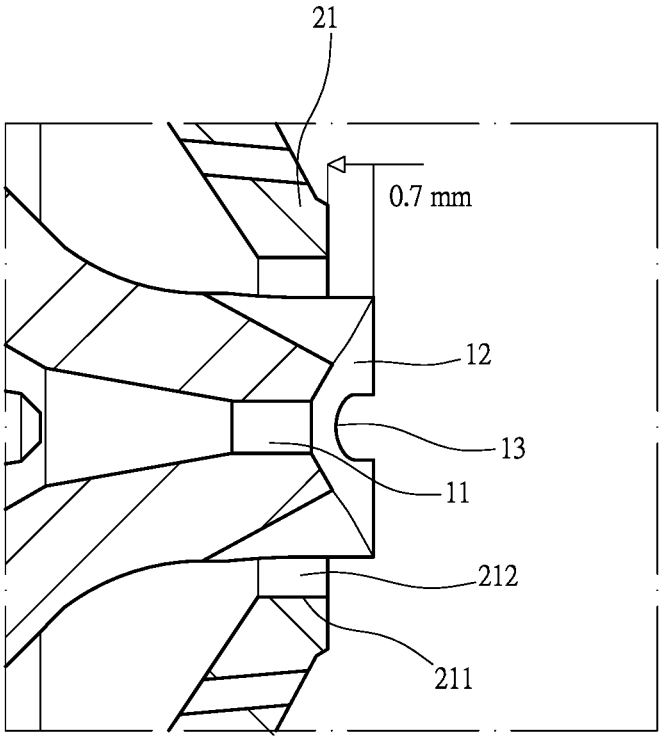
FIG. 7 is a partial enlarged view of FIG. 6.
Figure 8:
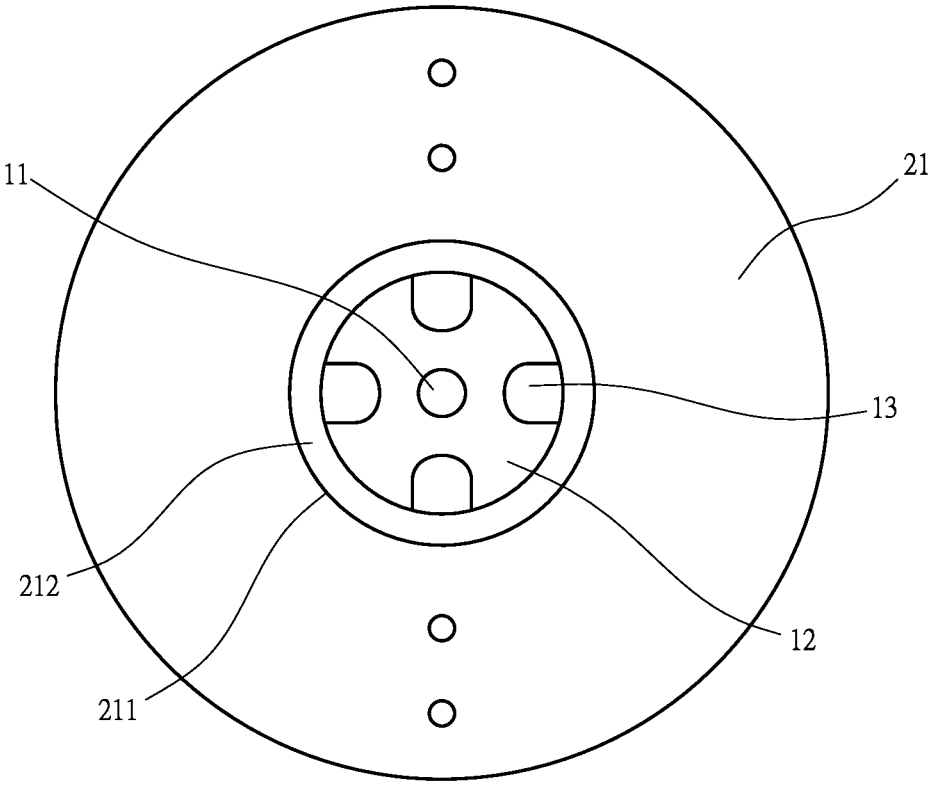
FIG. 8 is a front view illustrating the front end of the main body is surrounded by an air cap of the spray gun in the present invention.

In a preferred embodiment, referring to FIGS. 6 to 8, the main body (10) is surrounded by an air cap (21) of a spray gun (20) when connected to the spray gun (20), and a through hole (211) formed at a center of the air cap (21) is adapted to be passed through by the front end of the main body (10), and the front end of the main body (10) protrudes 0.7-1.2 mm out of the through hole (211), and an annular slit (212) is formed between the front end of the main body (10) and the through hole (211).

In actual application, referring to FIGS. 6 to 8, when the spray gun (20) is in use, the paint (A) is sprayed out from the spray hole (11), high-pressure airflow (b) of the spray gun (20) is configured to flow out from the annular slit (212) between an outer periphery of the main body (10) and the through hole (211) of the air cap (21) so as to mix and drive the paint (A) out of the main body (10). With the air grooves (13) on the front end of the main body (10) having the fixed groove diameter, when the high-pressure airflow (b) passes through the annular slit (212), the flow rate of the high-pressure airflow (b) passing through the air groove (13) is consistent, such that the flux of the high-pressure airflow (b) is increased, so as to well mix the paint (A) and increase the flux of the paint (A) out of the main body (10), thereby preventing the paint (A) from remained on the air cap (21) or the annular slit (212) and improving the painting efficiency and result.

Furthermore, when the spray gun nozzle of the present invention is in use, the spray gun (20) only needs low pressure airflow (7.5 psi) to achieve the painting work while the traditional nozzle needs 14.5 psi to complete the painting work, which greatly improves the practicability thereof.

Figure 9:
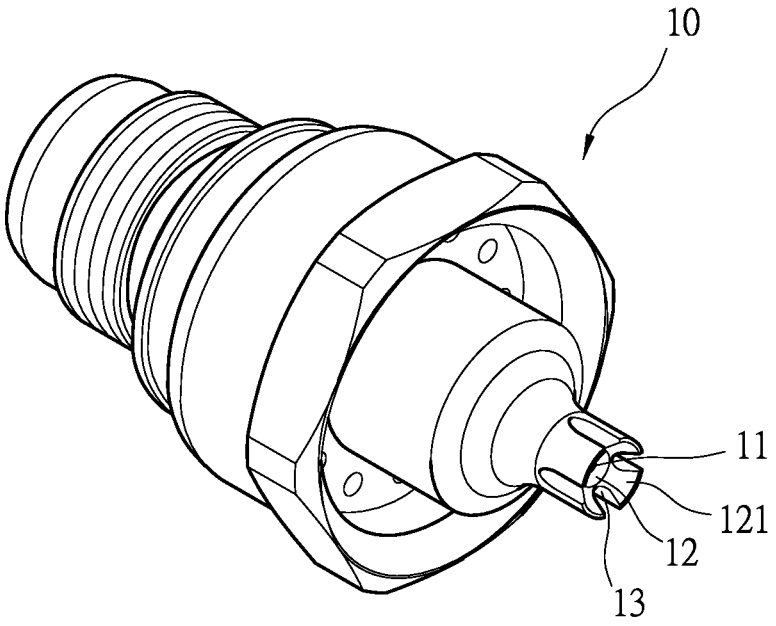
FIG. 9 is a three-dimensional assembly view of a second embodiment of the spray gun nozzle of the present invention.
Figure 10:
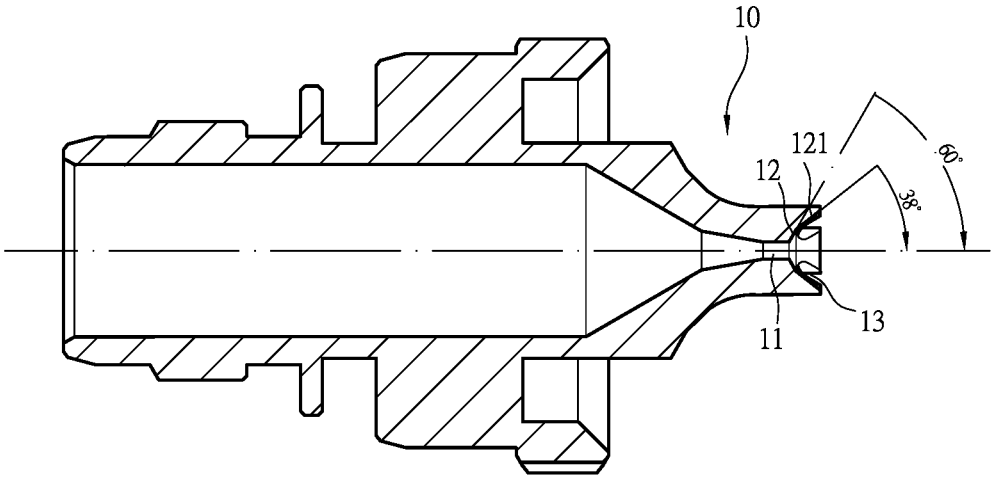
FIG. 10 is a sectional view of the second embodiment of the spray gun nozzle of the present invention.
Figure 11:
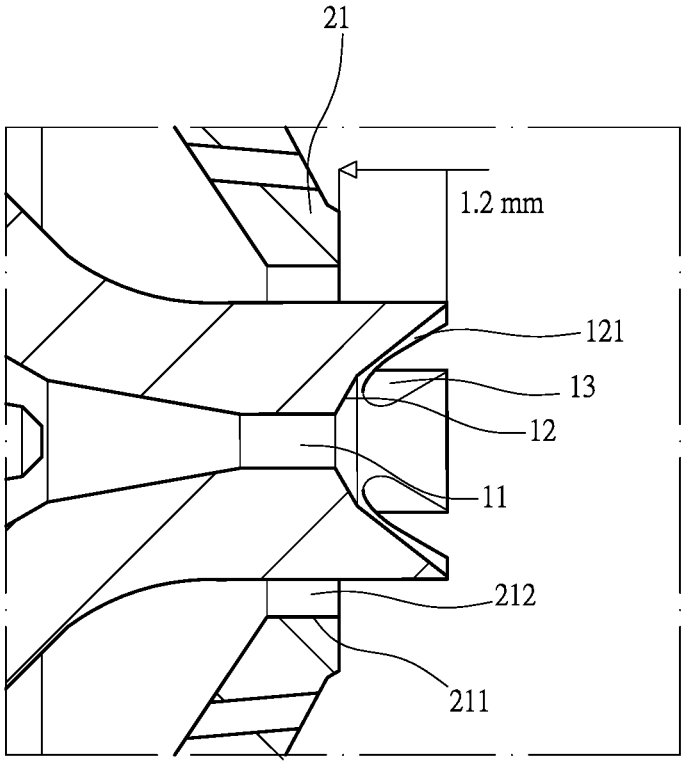
FIG. 11 is a partial enlarged schematic view of the second embodiment illustrating the main body of the spray gun nozzle is connected to the spray gun for use in the present invention.
Figure 12:
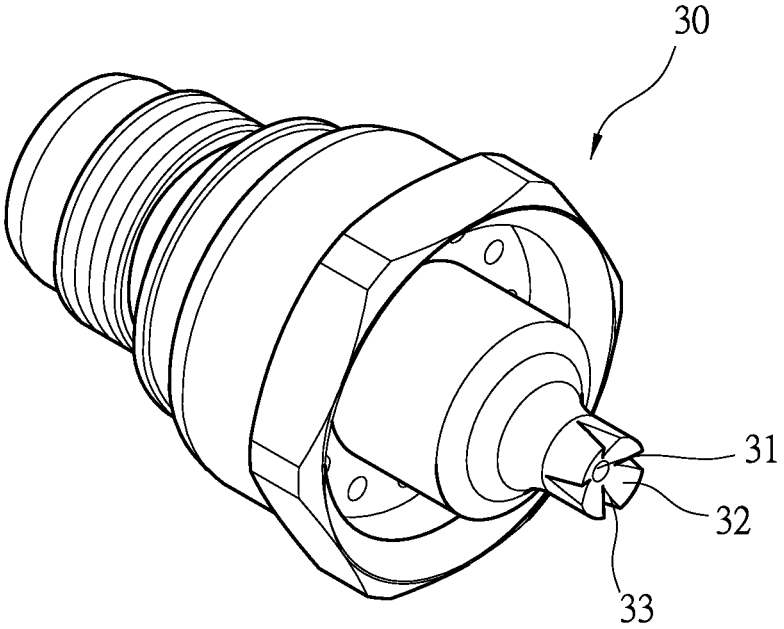
FIG. 12 PRIOR ART
FIG. 12 is a prior art.
Figure 13:
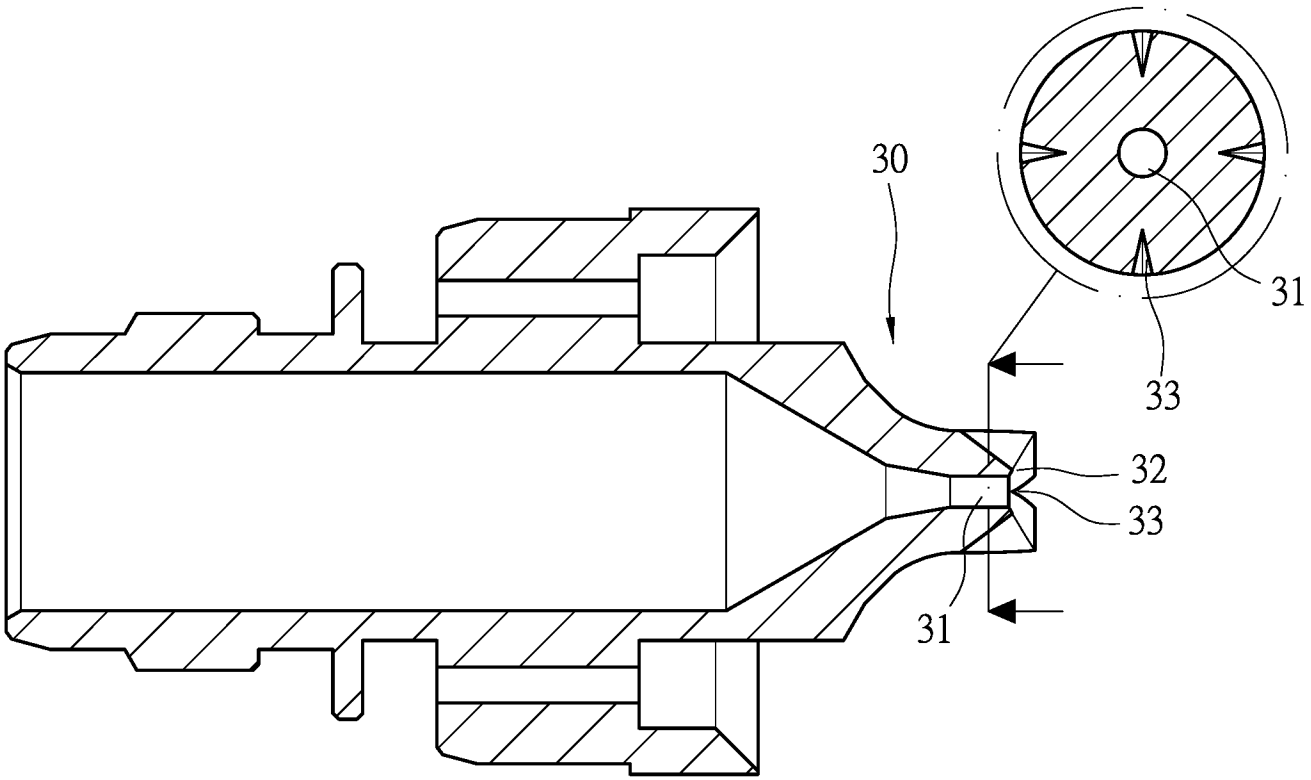
FIG. 13 PRIOR ART
FIG. 13 is a prior art.
Figure 14:
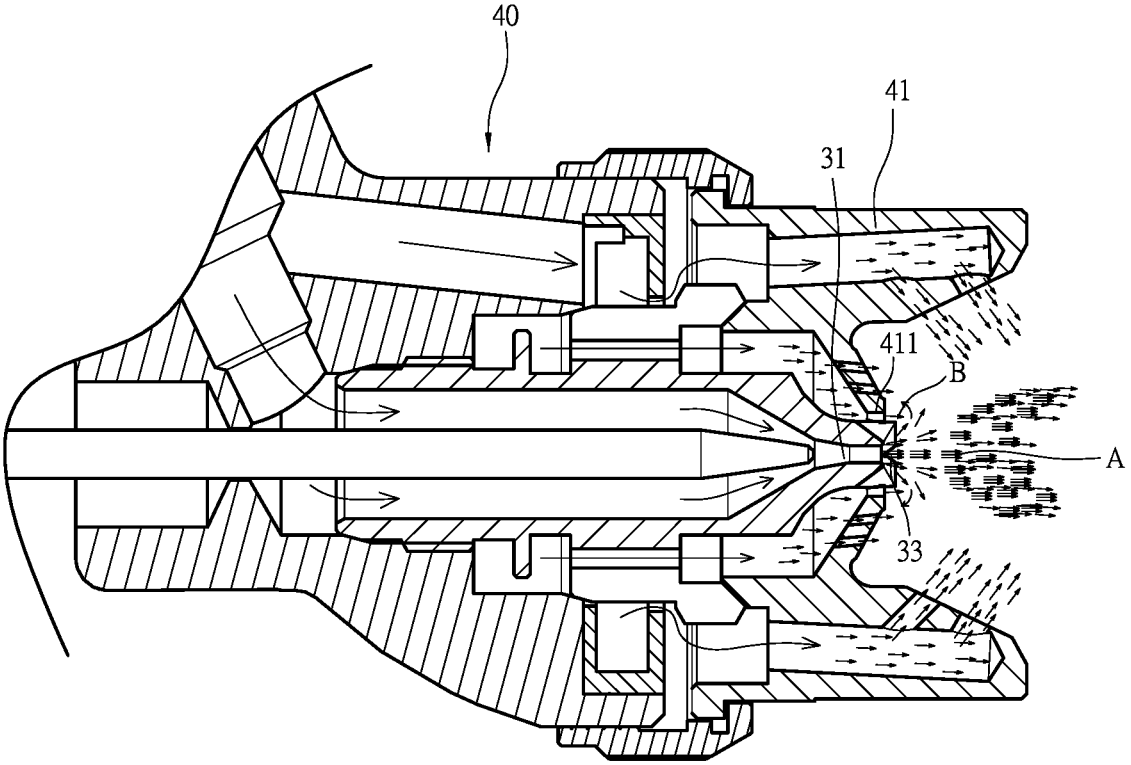
FIG. 14 PRIOR ART
FIG. 14 is a prior art.
Figure 15:
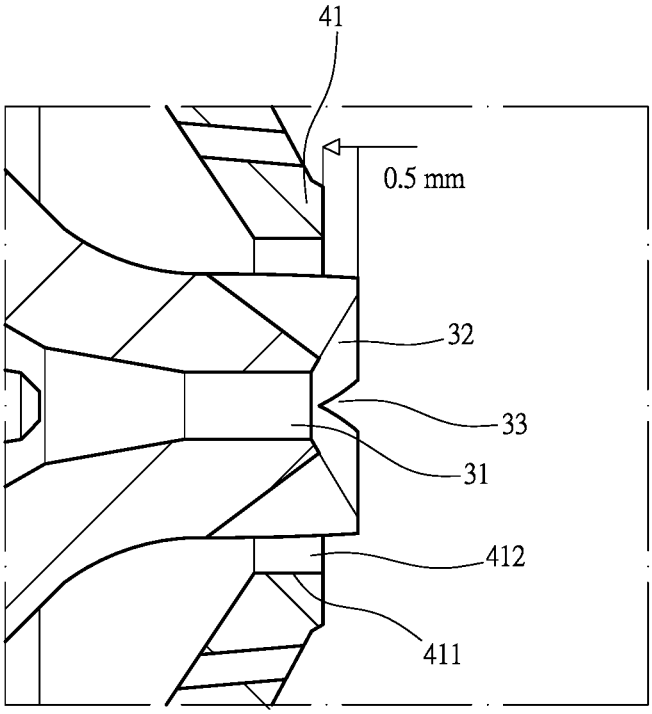
FIG. 15 PRIOR ART
FIG. 15 is a prior art.
Figure 16:
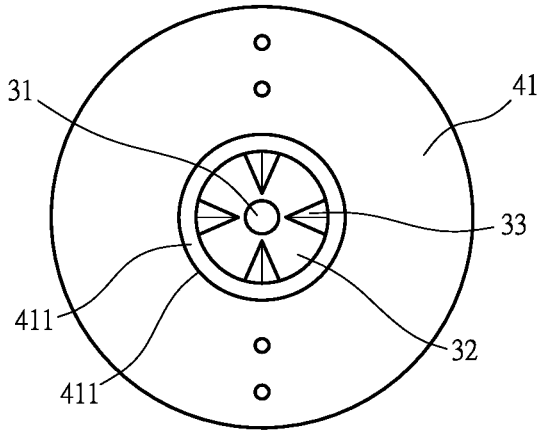
FIG. 16 PRIOR ART
FIG. 16 is a prior art.

In another embodiment, referring to FIGS. 9 to 11, a tapered cylindrical first surface (121) having gradually wider diameter from rear to front is extended forwardly from the guiding surface (12) of the main body (10), and the inclined angle of the first surface (121) with respect to the spray hole (11) is between 30 degrees and 45 degrees, and the preferred inclined angle is 38 degrees, such that the front end of the main body (10) has the guiding surface (12) and the first surface (121) with different inclined angles with respect to the spray hole (11); when the main body (10) is connected to the spray gun (20), the main body (10) is surrounded by the air cap (21), and the front end of the main body (10) penetrating through the through hole (211) of the air cap (21) protrudes 0.7-1.2 mm out of the through hole (211).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A spray gun nozzle comprising a main body, and a spray hole formed at a front end thereof; a tapered cylindrical guiding surface, which has a gradually wider diameter from a rear end to a front end of the cylindrical guiding surface, extended forwardly from the spray hole, and an inclined angle of the guiding surface with respect to an axis perpendicular to a plane in which the spray hole lies being between 45 degrees and 75 degrees; a plurality of air grooves, which have U-shaped cross-section, formed on an outer periphery of the front end of the main body and axially extending from a front end of the guiding surface, and the air grooves equally spaced apart;

wherein a tapered cylindrical first surface having gradually wider diameter from a rear end to a front end extending forwardly from the guiding surface of the main body, and the inclined angle of the first surface with respect to an axis perpendicular to a plane in which the spray hole lies is between 30 degrees and 45 degrees.

2. The spray gun nozzle of claim 1, wherein the inclined angle of the guiding surface with respect to the spray hole is 60 degrees.

3. The spray gun nozzle of claim 1, wherein the inclined angle of the first surface with respect to the axis perpendicular to the plane in which the spray hole lies is 38 degrees.

4. The spray gun nozzle of claim 1, wherein two of the air grooves formed at two lateral sides are in parallel.

5. The spray gun nozzle of claim 1, wherein two of the air grooves formed at two lateral sides are non-parallel with an outward expanding angle between 1 degree and 9 degrees.

6. The spray gun nozzle of claim 1, wherein a width of an opening of each of the air grooves is between 0.8 mm and 1.2 mm.

7. The spray gun nozzle of claim 1, wherein a length of each of the air grooves is between 2.5 mm and 3.5 mm.

* * * * *